US012715650B2

(12) United States Patent
Jöbges et al.

(10) Patent No.: US 12,715,650 B2
(45) Date of Patent: Aug. 25, 2026

(54) CLOSURE ASSEMBLY FOR A BEVERAGE CONTAINER AND METHOD FOR REPEATABLY CLOSING A BEVERAGE CONTAINER BY MEANS OF A CLOSURE ASSEMBLY

(71) Applicant: Ardagh Metal Beverage Holdings Germany GmbH, Bonn (DE)

(72) Inventors: Udo Jöbges, Düren (DE); Hajo Rieck, Hennef (DE); Peter Gonnert, Ostheim v.d. Rhön (DE)

(73) Assignee: Ardagh Metal Beverage Holdings Germany GmbH, Bonn (DE)

( * ) Notice: Subject to any disclaimer, the term of this patent is extended or adjusted under 35 U.S.C. 154(b) by 371 days.

(21) Appl. No.: 18/008,097

(22) PCT Filed: Jun. 4, 2021

(86) PCT No.: PCT/EP2021/065047
§ 371 (c)(1),
(2) Date: Dec. 2, 2022

(87) PCT Pub. No.: WO2021/245256
PCT Pub. Date: Dec. 9, 2021

(65) Prior Publication Data

US 2023/0271749 A1 Aug. 31, 2023

(30) Foreign Application Priority Data

Jun. 4, 2020 (DE) ..... 10 2020 114 863.1

(51) Int. Cl.
*B65D 17/34* (2006.01)
*B65D 17/50* (2006.01)
(Continued)

(52) U.S. Cl.
CPC ..... *B65D 17/34* (2018.01); *B65D 17/506* (2013.01); *B65D 43/265* (2013.01);
(Continued)

(58) Field of Classification Search
CPC ..... B65D 47/0857; B65D 47/0861; B65D 47/0866; B65D 47/0871; B65D 47/0876;
(Continued)

(56) References Cited

U.S. PATENT DOCUMENTS

2004/0159665 A1 8/2004 Morrissey et al.
2007/0290505 A1 12/2007 Lin
(Continued)

FOREIGN PATENT DOCUMENTS

DE 102016103801 9/2017
WO WO 93/25452 12/1993
WO WO 97/00214 1/1997

OTHER PUBLICATIONS

International Written Opinion for PCT/EP2020/063385, dated Jul. 14, 2020.

*Primary Examiner* — Allan D Stevens
(74) *Attorney, Agent, or Firm* — Knobbe, Martens, Olson & Bear, LLP

(57) ABSTRACT

A closure assembly for a beverage container includes: a lid having an opening and a closure for repeatably closing the opening, the closure element-being disposed on the lid; wherein the opening has an opening edge and an opening plane formed by the opening edge; wherein the closure has at least a base, a tab and a lever element; wherein the base comprises a frame disposed on the opening edge and has a window, and a flap, which is pivotably connected to the frame part in order to close the window and thus the opening; wherein the tab is pivotably connected to the frame by means of a first axis of rotation; and wherein the lever is
(Continued)

connected to the tab by means of a second axis of rotation and to the flap by means of a third axis of rotation.

21 Claims, 7 Drawing Sheets

(51) Int. Cl.
*B65D 43/26* (2006.01)
*B65D 51/16* (2006.01)

(52) U.S. Cl.
CPC ..... *B65D 51/1672* (2013.01); *B65D 2401/15* (2020.05); *B65D 2517/0007* (2013.01); *B65D 2517/0038* (2013.01); *B65D 2517/0043* (2013.01); *B65D 2517/0046* (2013.01)

(58) Field of Classification Search
CPC B65D 47/088; B65D 47/0885; B65D 47/089; B65D 47/0895; B65D 17/506; B65D 17/507; B65D 51/007; B65D 51/1672; B65D 2517/002; B65D 2517/0007; B65D 2517/0094; B65D 2517/0043; B65D 2517/0046; B65D 2517/0038; B65D 2517/0014; B65D 43/265; B65D 2401/15
USPC ..... 220/817, 826, 825, 818
See application file for complete search history.

(56) References Cited

U.S. PATENT DOCUMENTS

2012/0103987 A1* 5/2012 Lucas ..... B65D 17/506 220/260
2012/0145712 A1* 6/2012 Bratsch ..... B65D 47/36 220/254.2
2012/0248113 A1 10/2012 Majcen et al.
2014/0305942 A1* 10/2014 Van Goolen ..... B65D 43/161 220/260
2020/0031542 A1 1/2020 Morrissey

* cited by examiner

CLOSURE ASSEMBLY FOR A BEVERAGE CONTAINER AND METHOD FOR REPEATABLY CLOSING A BEVERAGE CONTAINER BY MEANS OF A CLOSURE ASSEMBLY

The present invention relates to a closure assembly for a beverage container, in particular a beverage can. The present invention furthermore relates to a method for repeatably closing an opening of a beverage container having a closure assembly, in particular having the described closure assembly. The closure assembly comprises at least one lid element with an opening and comprises a closure element which is non-detachably arranged on the lid element and which serves for repeatably closing the opening, in particular in gas-tight fashion. The lid element is in particular composed of metal. The beverage container serves for storing a content, for example a fluid, wherein the beverage container is positively pressurized in the closed state.

Specifically in the case of beverage cans with carbonated content, the beverage container, before being opened for the first time, may have an internal pressure of up to 6.2 bar.

Both closure assemblies that can be opened only once, and closure assemblies that are reclosable, are known for the closure of such beverage containers. The advantage of reclosable closure assemblies is obvious. With these, a beverage container can be closable, in particular in gas-tight fashion, even after being partially emptied, such that an escape of the fluid stored in the beverage container, and an escape of the carbonation in the specific case of carbonated contents, is prevented. The known reclosable closure assemblies commonly involve complex components or complex methods for opening and closing the closure assembly.

In particular, a captively retained arrangement of the closure assembly on the lid element or on the beverage container is desired here, such that all constituent parts of the beverage container can be passed on to a recycling process.

US 2012/248113 A1 has disclosed a reclosable closure for a beverage can. Here, a lever that is supported on the can lid is pivoted and, in the process, pushes a flap into the beverage container. To fix the closure in an opened position, the lever must then be arranged at least partially in the beverage container.

It is an object of the invention to at least partially solve the problems that exist with regard to the prior art, and in particular to provide a closure assembly for a beverage container, by means of which closure assembly the beverage container is repeatably reclosable, in particular in gas-tight fashion.

In particular, it is the intention for a closure element of the closure assembly to at the same time be captively arranged or fastened on the beverage container.

It is furthermore optionally also the intention that reclosure of the beverage container by means of the closure assembly is possible even after the initial opening, with leak-tightness of the beverage container (with respect to atmospheric pressure) being ensured both in the case of a low pressure in the beverage container and even in the case of a pressure of up to 6.2 bar within the beverage container.

It is furthermore desired to specify as simple a method as possible for repeatably closing an opening of a beverage container having a closure assembly.

Said objects are achieved by means of a closure assembly as per the features of claim 1 and by means of a method as per the features of claim 20. Further advantageous embodiments of the closure assemblies and of the method are specified in the dependent claims. It is pointed out that the features individually specified in the dependent claims may be combined with one another in a technologically meaningful manner and define further embodiments of the invention. Furthermore, the features specified in the claims are specified more precisely and discussed in more detail in the description, with further preferred embodiments of the invention being presented.

This is contributed to by a closure assembly for a beverage container. The closure assembly comprises a lid element with an opening and comprises a closure element which is arranged on the lid element and which serves for repeatably closing the opening. The lid element has an outer side and an inner side, and the opening has an opening edge and an opening plane formed by the opening edge. The closure element has at least a base part, a tab and a lever element. The base part has a frame part, which is arranged on the opening edge and which has a window, and a flap, which is pivotably connected to the frame part for the purposes of closing the window and thus the opening. The tab is pivotably connected (only) via a first axis of rotation to the frame part. The lever element is connected (only) via a second axis of rotation to the tab and (only) via a third axis of rotation to the flap.

In particular, the lid element is a known lid, for example of a beverage can, which lid is connected or connectable to the beverage can. The lid element is preferably non-separately connected to (only destructively separable from) the beverage container. In particular, the lid element is composed of a metal or alloy.

The inner side of the lid element forms that side of the lid element which faces toward the content of the beverage container, with the outer side of the lid element forming that side of the lid element which faces away from the content.

The opening of the lid element is in particular simultaneously the (sole) pouring opening for a content of the beverage container. The shape of the opening is in particular not specified. The opening is in particular not rotationally symmetrical. A rotationally symmetrical opening is however also closable by means of the closure element described here, and thus encompassed by the term "opening".

A new state of the closure element refers in particular to the state of the closure element prior to the tab being actuated, that is to say pivoted, for the first time.

In the new state, the tab is situated in an initial position, that is to say in a non-pivoted state. If the tab is situated in the non-pivoted initial position, the flap has also not been pivoted, and the window or the opening is thus closed.

The tab is in particular pivotable between the non-pivoted initial position and an in particular maximally pivoted end position. In the end position of the tab, the flap is in particular arranged in a maximally pivoted position, and the window or the opening is open to a maximum extent.

In particular, in the initial position, the content of the beverage container is sealed off, in particular in gas-tight fashion, with respect to the surroundings of the beverage container, in particular in respect of a pressure within the beverage container of at least 3 bar, preferably at least 5 bar, particular preferably at least 6.2 bar. In particular, however, a seal exists even if the pressure within the beverage container corresponds to the pressure of the surroundings.

The closure element is in particular of single-piece form, that is to say the individual components base part, tab and lever element are captively connected to one another (via the axes of rotation, in particular only via the axes of rotation). In particular, said components are producible independently of one another and connectable to one another during the course of an assembly process.

In particular, the first axis of rotation and the second axis of rotation are arranged parallel and with a spacing to one another.

In particular, the frame part is arranged in positionally fixed and immovable fashion on the opening edge. The lever element, the flap and the tab are connected to the lid element via the frame part. The lever element, flap and tab are arranged so as to be movable relative to the frame part.

In particular, the third axis of rotation is also arranged parallel to the other axes of rotation.

During a pivoting movement of the tab, the tab is in particular rotated relative to the frame part about the first axis of rotation. Owing to the spacing between the first axis of rotation and the second axis of rotation, the second axis of rotation, that is to say the connection between the lever element and the tab, likewise rotates about the first axis of rotation during the course of this first pivoting movement.

In particular, the third axis of rotation is arranged spaced apart from the second axis of rotation, and optionally also spaced apart from the first axis of rotation. In particular, a position of the third axis of rotation relative to the first axis of rotation changes owing to the rotation of the second axis of rotation about the first axis of rotation. The spacing between the second axis of rotation and the third axis of rotation is in particular constant, or is defined by the lever element on which said two axes of rotation are arranged.

In particular, the tab is pivotable from a non-pivoted initial position in a first pivoting movement about the first axis of rotation and, as a result of this first pivoting movement, the flap is pivotable relative to the frame part. The motion of the first pivoting movement is in particular coupled via the lever element to the motion, for example of a second pivoting movement, of the flap.

In particular, the tab, the base part and the lever element interact in the manner of a toggle lever, such that a first pivoting movement of the tab about the first axis of rotation by a first angular extent causes a second pivoting movement of the flap relative to the opening plane, and a further first pivoting movement of the tab by a further first angular extent causes a third pivoting movement of the flap. Here, the second pivoting movement and the third pivoting movement are of different magnitude.

In particular, the flap is connected to the frame part (only) via a fourth axis of rotation, or else optionally via a hinge. In the case of a hinge, not only a rotational movement but also a translational movement of the flap relative to the frame part is possible, for example in the case of a film hinge. In the case of a film hinge, the flap and frame part are connected to one another via an elastically deformable portion.

If the flap is connected via a fourth axis of rotation to the frame part, that is to say if only a rotational movement of the flap relative to the frame part about the axis is possible, the action of a toggle lever is clearly comprehensible from the different angular extents of the second pivoting movement and of the third pivoting movement.

In the case of a toggle lever, as in the case of any lever, in accordance with the lever principle, a long stroke with a low pulling or pushing force is converted into a short stroke with high force, or vice versa. The special feature of a toggle lever lies in the fact that the transmission ratio of applied force to resultant force, or of primary stroke to secondary stroke, varies continuously during the movement.

Here, it is proposed in particular that, proceeding from the initial position, a first pivoting movement of the tab initially causes only a small second pivoting movement of the flap, or said second pivoting movement only occurs in the first place beyond a minimum extent of the first pivoting movement. If the tab is pivoted progressively further, that is to say to the end position of the tab, the flap is pivoted with increasing intensity.

In the case of an unchanging rotational speed of the tab about the first axis of rotation, it is thus the case in particular that a rotational speed of the flap, for example about the fourth axis of rotation, varies. In particular, a rotational speed of the flap is very low initially, that is to say proceeding from the initial position, whereas the rotational speed of the flap increases as a first pivoting movement of the tab progresses.

In particular, the acting forces or torques vary inversely with respect to the rotational speeds or the speeds of the respective pivoting movement. In particular, in the case of the very low rotational speed of the flap, a very high torque can be transmitted to the flap, such that, specifically in the region of the initial position, that is to say when the flap bears against the frame part for the purposes of closing the window, a high torque is present for sealing the connection between flap and frame part or for opening the flap, that is to say for performing the second pivoting movement.

In particular, proceeding from a non-pivoted initial position, the first pivoting movement of the tab by at least 45 angular degrees, preferably by at least 50 angular degrees, particularly preferably by at least 55 angular degrees, causes the second pivoting movement of at most 5 angular degrees, preferably of at most 3 angular degrees, particularly preferably of at most 2.5 angular degrees. In particular, it is thus the case that, proceeding from a non-pivoted initial position, the first pivoting movement of the tab by at least 55 angular degrees causes the second pivoting movement of at most 2.5 angular degrees.

In particular, proceeding from the non-pivoted initial position, the first pivoting movement of the tab by at most 150 angular degrees, preferably by at most 160, particularly preferably by at most 165 angular degrees, causes the second pivoting movement of at least 30 angular degrees, preferably of at least 32 angular degrees, particularly preferably of at least 34 angular degrees. In particular, it is thus the case that, for example proceeding from the non-pivoted initial position, the first pivoting movement of the tab by at most 150 angular degrees causes the second pivoting movement of at least 34 angular degrees. In particular, proceeding from the non-pivoted initial position, the first pivoting movement of the tab by between 150 and 180 angular degrees causes the second pivoting movement of at least 30 to 50 angular degrees.

In particular, the flap is connected to the frame part via a hinge.

In particular, the frame part is arranged captively on the opening edge. In particular, the frame part is arranged on the opening edge via a form-fitting connection, and is detachable from the opening edge only through destruction of the frame part. In particular, the frame part is installed on the opening edge by way of a plastic deformation of the frame part. The plastic deformation may for example be performed by way of a thermal treatment of the frame part, for example at least local heating.

In particular, the closure element allows repeatable gas-tight closure of the opening. In particular, the closure element thus allows not only closure or liquid-tight closure but also gas-tight closure of the opening. In this way, in the specific case of carbonated liquids, effective sealing of the opening is possible even after the initial opening of the closure element.

In particular, between the inner side and a contact surface of the frame part, there is arranged a first gasket which encircles the opening. In particular, the contact surface is oriented at least partially parallel to a partial surface of the inner side of the lid element. The first gasket is in particular arranged in the region of said partial surface. In particular, the first gasket is fastened to the frame part and is arranged on said partial surface during the course of installation of the frame part on the lid element. In particular, the first gasket is producible or produced together with the frame part, and optionally also with the flap, during the course of a two-component injection molding process.

In particular, between the frame part and the flap, there is arranged a second gasket which encircles the window. Said second gasket allows sealing of the window or of the opening by way of a sealed connection between flap and frame part. In particular, the second gasket is arranged on the frame part or on the flap. In particular, the second gasket is producible or produced together with the frame part, and optionally also with the flap, during the course of a two-component injection molding process.

In particular, the frame part and/or the flap and/or the tab and/or the lever element is produced from a plastic with a modulus of elasticity of at least 1100 MPa [megapascals], in particular of at least 1300 MPa, preferably of at least 1600 MPa.

Preferably, the first gasket and/or the second gasket is produced from a plastic with a Shore A hardness of at most 60, in particular of at most 45, preferably of at most 35.

In particular, the tab is connected, only in a non-pivoted initial position, via a seal element to the base part. In particular, the connection via the seal element is destroyed when a first pivoting movement of the tab is performed for the first time. The seal element serves for indicating the state of the closure element or of the beverage container. An undamaged seal element signals that the closure element has not yet been actuated, that is to say the beverage container has not yet been opened. By contrast, a damaged seal element signals that the closure element has been actuated at least once, that is to say the beverage container has been opened at least once.

In particular, the base part has a ventilation element, wherein, upon a first pivoting movement of the tab, a fluidic connection is formed between the inner side and the outer side through the ventilation element; wherein the first pivoting movement of the tab causes a deformation of the ventilation element. In particular, the ventilation element is arranged on the frame part or on the flap. In particular, the ventilation element is integrally connected to the base part. In particular, the ventilation element is producible or produced together with the frame part and/or with the flap during the course of a two-component injection molding process.

In particular, the ventilation element is of tubular design and makes a fluidic connection possible between the interior of the beverage container and the surroundings of the beverage container. In particular, venting, that is to say a pressure equalization between the interior of the beverage container and the surroundings of the beverage container, is possible via the ventilation element. In particular, the ventilation element has, along the tubular form, a preferably constant minimum opening cross section of 1 to 4 $mm^2$. In particular, this minimum opening cross section is at least locally reduced to zero in the deformed state of the ventilation element, such that, when the tab is arranged in the initial position, the fluidic connection is shut off, and therefore no ventilation is possible via the ventilation element.

The ventilation element may alternatively be designed, for example of rigid form, such that the tab closes the minimum opening cross section by way of a closing element of the tab, by virtue of the closing element assuming a position in the minimum opening cross section.

In particular, in the non-pivoted initial position of the tab, the flap forms a fluid-tight connection with the frame part, wherein, upon a first pivoting movement of the tab, the fluid-tight connection can be eliminated as a result of the second pivoting movement of the flap. A fluidic connection of the inner side to the outer side occurs exclusively by way of the elimination of the fluid-tight seal.

In particular, in the case of commercial beverage can lids, a maximum force (greatest force) required for pivoting the tab is on average approximately 21 N [newtons]. This is in particular the force measured on common, fully automatic opening force measurement appliances in production facilities for beverage can lids. This is at the same time the maximum force that must be imparted by the end customer/consumer in order to open the can.

In particular, a force required for pivoting the tab is at most 20 N, preferably at most 15 N, particular preferably at most 10 N.

In particular, a force required for pivoting the tab can have considerably lower values (in particular forces reduced by more than 20%) than in the case of conventional closure elements, because it is in particular the case here that no severing of material is required, it merely being necessary for fluid-tight connections to be eliminated by way of the movement of parts that are movable relative to one another. In the case of conventional closure elements, it is for example the case that severing of material, for example the severing of plastics or metal materials, occurs, for which a high force or a high torque is necessary.

In the case of the closure element proposed here, it is for example merely the case that the flap is pivoted away from the frame part in order to open up the window or the opening. Here, before the pivoting of the flap, it is in particular the case that venting occurs via a ventilation element, such that the flap does not need to be moved counter to the internal pressure that may prevail in the beverage container. Pivoting of the flap may however also be possible with low torques even without a ventilation element or venting, because a low torque at the tab is converted into a high torque at the flap owing to the toggle lever principle that is implemented.

In particular, the tab assumes a self-locking position at least in a non-pivoted initial position or in the region of a maximally pivoted end position. The region encompasses in particular an angle range of at most 10 angular degrees about the maximally pivoted end position. In particular, said self-locking position is stable, that is to say a torque is required to move the tab out of said position. In particular, this self-locking position exists only in the region of the maximally pivoted end position. In particular, the tab is, in particular after the first actuation or pivoting of the tab, held in the initial position by way of an elastic deformation of another component of the closure element. The elastic deformation of the other component allows the formation, in particular, of a form fit or of a force fit, which prevents a further pivoting movement of the tab. This form fit or force fit can be eliminated again in particular by way of an actuation of the tab.

Force-fitting connections necessitate a normal force on the surfaces that are to be connected to one another. The relative displacement of said surfaces is prevented for as long as the opposing force caused by static friction is not exceeded.

Connections are referred to as form-fitting connections if the connecting partners are held together by way of a geometrical arrangement. Form-fitting connections arise as a result of the interlocking of at least two connecting partners. In this way, the connecting partners cannot be released from one another even in the absence of a transmission of force or when a transmission of force is interrupted. In other words, in the case of a form-fitting connection, one of the connecting partners stands in the way of the other.

In particular, the tab, in a non-pivoted initial position, is arranged so as to be protected with respect to surroundings by a protective flap.

In particular, the protective flap is pivotably connected (only) via a fifth axis of rotation to the tab. In particular, the fifth axis of rotation is arranged at least parallel to the first, second and third axes of rotation. In particular, the fifth axis of rotation is arranged spaced apart from each of the first, second and third axes of rotation.

In particular, the protective flap is pivoted in a first direction of rotation about the fifth axis of rotation for the purposes of actuating the tab and for the purposes of opening the flap. In particular, here, the tab is pivoted in an opposite, second direction of rotation about the first axis of rotation (that is to say relative to the frame part), such that the flap is then actuated via the lever element. In particular, here, the protective flap is at least temporarily supported on the closure assembly.

In particular, the protective flap covers the opening and/or the window and thus enables at least parts of the closure element to be arranged so as to be protected with respect to the surroundings.

In particular, the protective flap has a seal element via which the protective flap is connected, preferably cohesively connected, to another part of the closure element, for example to the frame part, (only) before the first actuation of the closure element. A movement of the protective flap for the first time causes the seal element to be destroyed, such that it is easily possible for a user to identify that the beverage container has been opened at least once.

The use of the above-described closure assembly for the repeatable fluid-tight closure (and opening) of a beverage can is proposed.

Also proposed is a closure element, in particular for the above-described closure assembly. The closure assembly has at least has at least a base part, a tab and a lever element. The base part has a frame part, which is arranged on the opening edge and which has a window, and a flap, which is pivotably connected to the frame part for the purposes of closing the window and thus the opening. The tab is pivotably connected via (only) a first axis of rotation to the frame part. The lever element is connected (only) via a second axis of rotation to the tab and (only) via a third axis of rotation to the flap.

In particular, the base part is a single-piece injection-molded part that is formed using at least two materials, specifically one material for the at least one gasket and/or the ventilation element and one material for at least one of frame part and flap.

In particular, the closure element comprises three injection-molded parts, base part, lever element and tab, wherein these are assembled to form the closure element. In particular, these components are captively connected to one another (via the axes of rotation, in particular only via the axes of rotation).

Also proposed is a method for repeatably closing an opening of a beverage container having a closure assembly, in particular having the described closure assembly. The closure assembly at least comprises a lid element of the beverage container with an opening and comprises a closure element which is arranged on the lid element and which serves for repeatably closing the opening. The lid element has an outer side and an inner side, and the opening has an opening edge and an opening plane formed by the opening edge. The closure element has at least a base part, a tab and a lever element. The base part has a frame part, which is arranged on the opening edge and which has a window, and a flap, which is pivotably connected to the frame part for the purposes of closing the window and thus the opening. The tab is pivotably connected (only) via a first axis of rotation to the frame part. The lever element is connected (only) via a second axis of rotation to the tab and (only) via a third axis of rotation to the flap.

Proceeding from a non-pivoted initial position of the tab, in which the window is closed by the flap, the method has at least the following steps:

a) pivoting the tab about the first axis of rotation by a first angular extent in a first pivoting movement, wherein the flap is thus pivoted relative to the opening plane through a second pivoting movement;

b) performing a further first pivoting movement of the tab by a further first angular extent, wherein the flap is thus pivoted relative to the opening plane through a third pivoting movement;

wherein the second pivoting movement and the third pivoting movement are of different magnitude.

In particular, preferably proceeding from the initial position, the tab may be pivoted by a first angular extent during the course of a first pivoting movement, wherein the flap is moved by an angular extent of zero angular degrees, that is to say is not (yet) pivoted. The first angular extent is in this case in particular at least 5 angular degrees, preferably at least 15 angular degrees, particularly preferably at least 25 angular degrees.

In particular, the tab, the base part and the lever element interact in the manner of a toggle lever, such that a first pivoting movement of the tab about the first axis of rotation by a first angular extent causes a second pivoting movement of the flap relative to the opening plane, and a further first pivoting movement of the tab by a further first angular extent causes a third pivoting movement of the flap.

In particular, the base part has a ventilation element, wherein, upon a first pivoting movement of the tab out of the non-pivoted initial position, a fluidic connection is formed between the inner side and the outer side through the ventilation element, and pressure equalization between the beverage container and surroundings is thus realized. The first pivoting movement of the tab causes a deformation of the ventilation element.

In particular, in the non-pivoted initial position of the tab, the flap forms a fluid-tight connection with the frame part, wherein, upon a first pivoting movement of the tab, the fluid-tight connection is eliminated as a result of the second pivoting movement of the flap. Pressure equalization between a content of the beverage container and surroundings is performed exclusively by way of the elimination of the fluid-tight seal (between flap and frame part).

The statements made with regard to the closure assembly apply equally to the closure element, to the use of the closure assembly and of the closure element, and to the method, and vice versa.

The use of indefinite articles ("a" and "an"), in particular in the claims and in the description reflecting said claims, is to be understood as such and not in a numerical sense. Where terms or components are correspondingly introduced using such articles, it is thus to be understood that these are present at least singularly, but may in particular also be present plurally.

By way of precaution, it should be noted that the numerical terms ("first", "second", . . . ) used here serve primarily (only) for distinction between several similar articles, dimensions or processes, that is to say in particular do not imperatively specify a dependency and/or sequence of said articles, dimensions or processes. Should a dependency and/or sequence be necessary, this is explicitly specified here, or is obviously apparent to a person skilled in the art from studying the specific embodiment being described. Where a component may be present plurally ("at least one"), the description relating to one of said components may apply to all or a proportion of the multiplicity of said components, though this is not imperative.

The invention and the technical field will be discussed in more detail below on the basis of the appended figures. It is to be noted that the invention is not intended to be restricted by the exemplary embodiments specified. In particular, unless explicitly presented otherwise, it is also possible for partial aspects of the substantive matter discussed in the figures to be extracted and combined with other constituents and findings from the present description. In particular, it is to be noted that the figures and in particular the illustrated proportions are merely schematic. In the figures.

Figure 1:
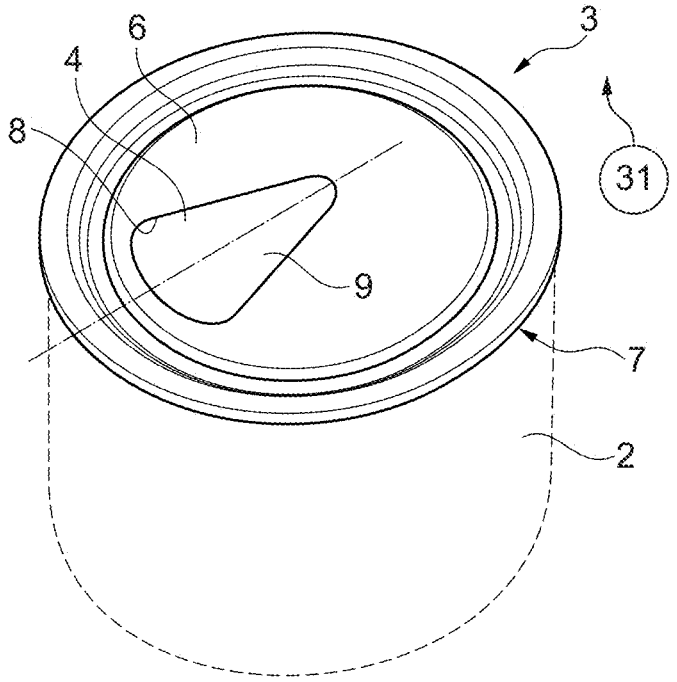
FIG. 1 shows a lid element in a perspective view.

FIG. 1 shows a lid element 3 in a perspective view. The lid element 3 has an outer side 6 and an inner side 7 and an opening 4. The opening 4 has an opening edge 8 and an opening plane 9 formed by the opening edge 8. The lid element 3 is connected or connectable to the beverage container 2. The lid element 3 is non-separately connected to (only destructively separable from) the beverage container 2. The inner side 7 of the lid element 3 forms that side of the lid element 3 which faces toward the content of the beverage container 2, with the outer side 6 of the lid element 3 forming that side of the lid element 3 which faces away from the content and toward surroundings 31. The opening 4 of the lid element 3 is the sole pouring opening for a content of the beverage container 2.

Figure 2:
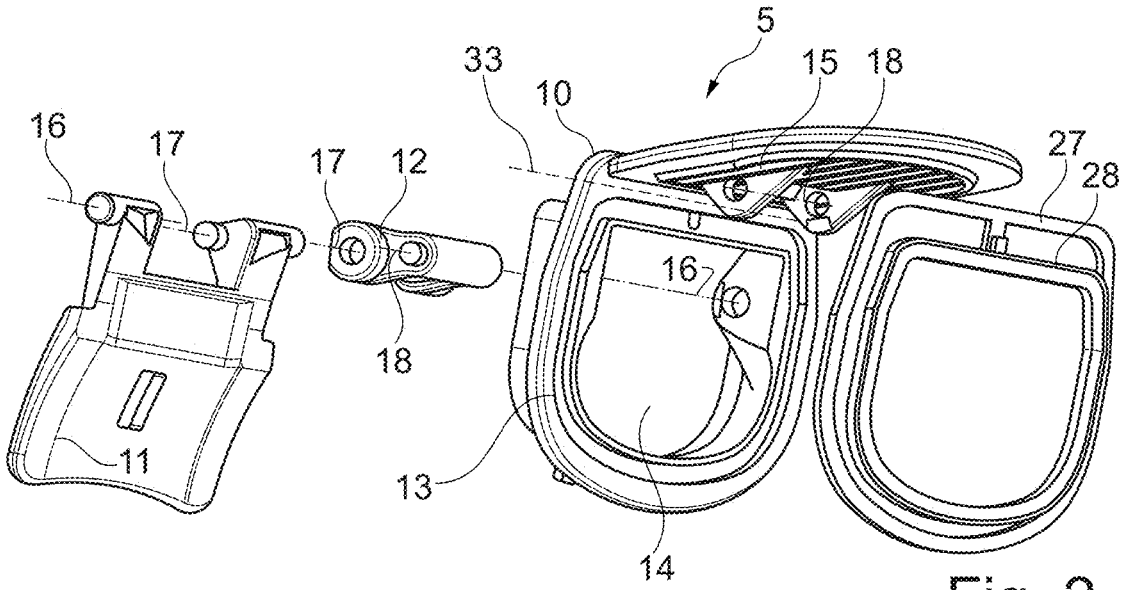
FIG. 2 shows a closure element in an exploded illustration in a perspective view.
Figure 3:
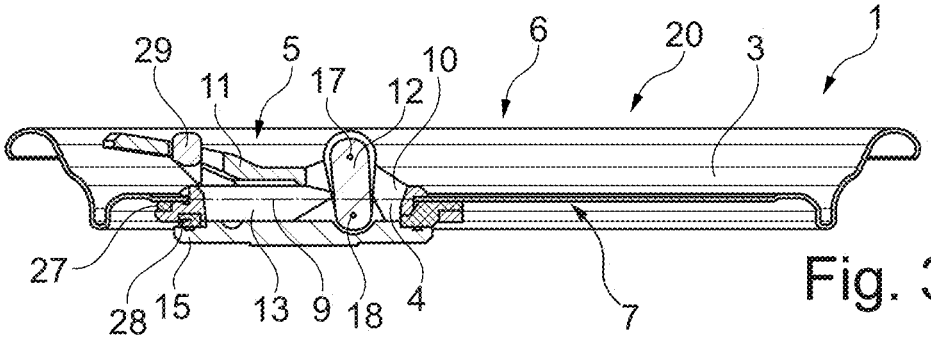
FIG. 3 shows a closure assembly in a side view in section.
Figure 4:
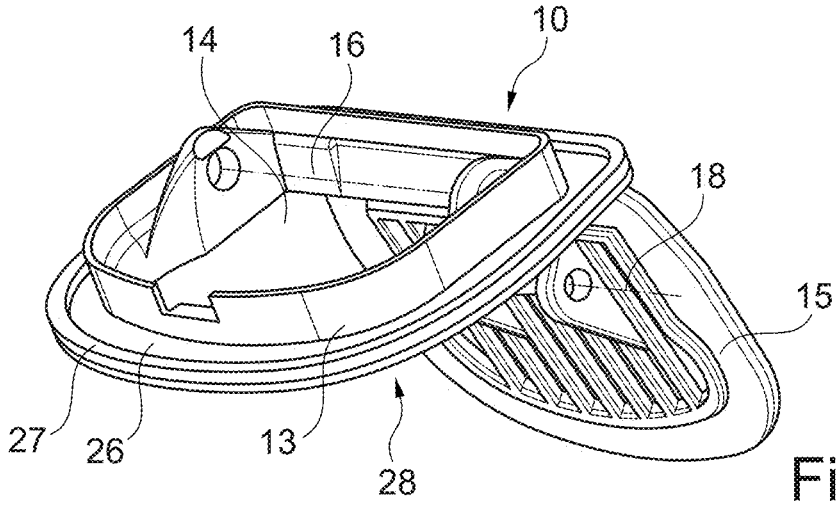
FIG. 4 shows a base part of the closure element as per FIG. 3.

FIG. 2 shows a closure element 5 in an exploded illustration in a perspective view. FIG. 3 shows a closure assembly 1 in a side view in section. FIG. 4 shows a base part 10 of the closure element 5 as per FIG. 3. FIGS. 2 to 4 will be described jointly below. Reference is made to the statements relating to FIG. 1.

The closure assembly 1 comprises a lid element 3 with an opening 4 and comprises a closure element 5 which is arranged on the lid element 3 and which serves for repeatably closing the opening 4. The lid element 3 has an outer side 6 and an inner side 7, and the opening 4 has an opening edge 8 and an opening plane 9 formed by the opening edge 8. The closure element has a base part 10, a tab 11 and a lever element 12. The base part 10 has a frame part 13, which is arranged on the opening edge 8 and which has a window 14, and a flap 15, which is pivotably connected to the frame part 13 for the purposes of closing the window 14 and thus the opening 4. The tab 11 is pivotably connected via a first axis of rotation 16 to the frame part 13. The lever element 12 is connected via a second axis of rotation 17 to the tab 11 and via a third axis of rotation 18 to the flap 15.

A new state of the closure element 5, as illustrated in FIG. 3, refers to the state of the closure element 5 prior to the tab 11 being actuated, that is to say pivoted, for the first time.

In the new state, the tab 11 is situated in an initial position 20, that is to say in a non-pivoted state. If the tab 11 is situated in the non-pivoted initial position 20, the flap 15 has also not been pivoted, and the window 14 or the opening 4 is thus closed.

Figure 9:
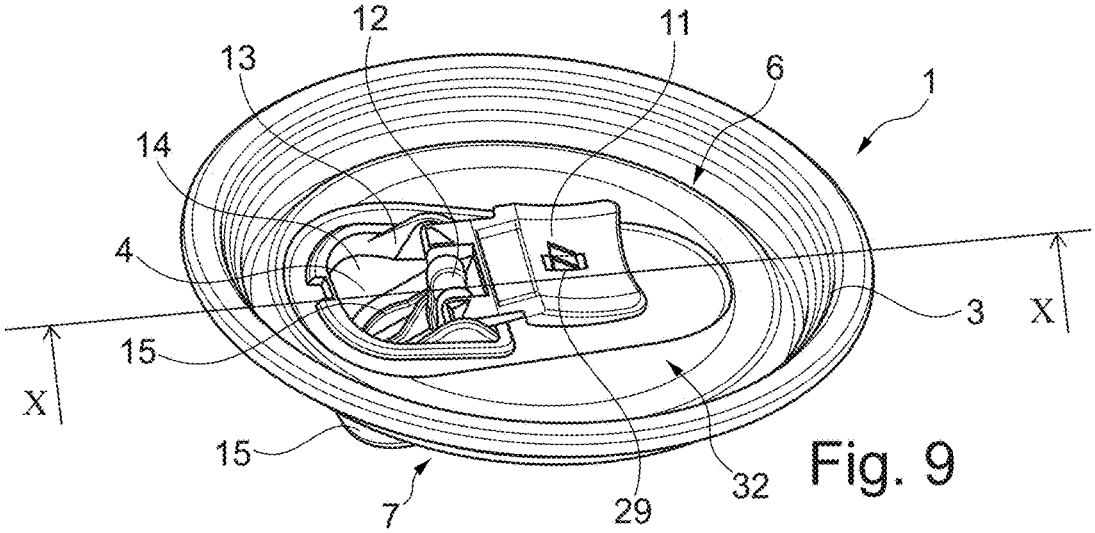
FIG. 9 shows the closure assembly as per FIG. 3 in a perspective view, with the tab in an end position and section line X-X.
Figure 10:
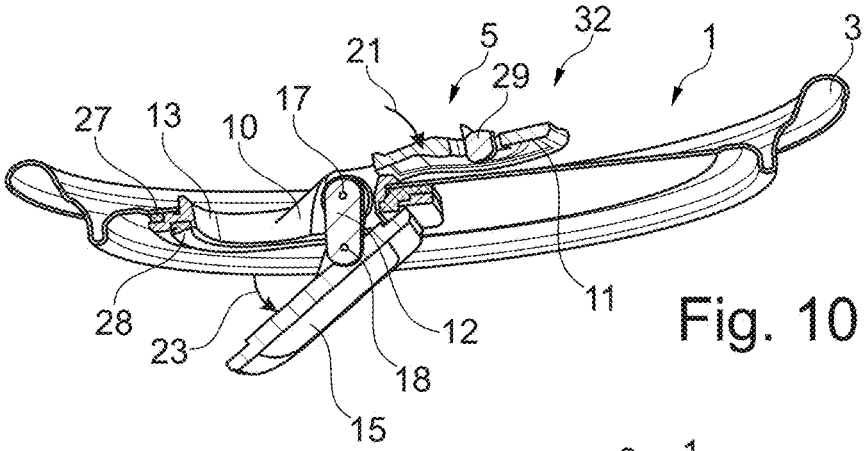
FIG. 10 shows the closure assembly as per FIG. 9 in a perspective view shown at a cross-section along section line X-X.

The tab 11 is pivotable between the non-pivoted initial position 20 and a maximally pivoted end position 32 (see FIGS. 9 and 10). In the end position 32 of the tab 11, the flap 15 is arranged in a maximally pivoted position, and the window 14 or the opening 4 is open to a maximum extent.

In the initial position 20, the content of the beverage container 2 is sealed off in gas-tight fashion with respect to the surroundings 31 of the beverage container 2.

The closure element 5 is of single-piece form, that is to say the individual components base part 10, tab 11 and lever element 12 are captively connected to one another. It can be seen in FIG. 2 that said components are producible independently of one another and connectable to one another during the course of an assembly process.

The first axis of rotation 16 and the second axis of rotation 17 are arranged parallel and with a spacing 19 to one another.

The frame part 13 is arranged in positionally fixed and immovable fashion on the opening edge 8. The lever element 12, the flap 15 and the tab 11 are connected to the lid element 3 via the frame part 13. The lever element 12, flap 15 and tab 11 are arranged so as to be movable relative to the frame part 13.

In particular, the third axis of rotation 18 is also arranged parallel to the other axes of rotation 16, 17.

During a pivoting movement of the tab 11, the tab 11 is in particular rotated relative to the frame part 13 about the first axis of rotation 16. Owing to the spacing 19 between the first axis of rotation 16 and the second axis of rotation 17, the second axis of rotation 17, that is to say the connection between the lever element 12 and the tab 11, likewise rotates about the first axis of rotation 16 during the course of this first pivoting movement 21.

The third axis of rotation 18 is arranged spaced apart from the second axis of rotation 17, and also spaced apart from the first axis of rotation 16. A position of the third axis of rotation 18 relative to the first axis of rotation 16 changes owing to the rotation of the second axis of rotation 17 about the first axis of rotation 16. The spacing between the second axis of rotation 17 and the third axis of rotation 18 is constant, or is defined by the lever element 12 on which said two axes of rotation 17, 18 are arranged.

The tab 11 is pivotable from a non-pivoted initial position 20 in a first pivoting movement 21 about the first axis of rotation 16 and, as a result of this first pivoting movement 21, the flap 15 is pivotable relative to the frame part 13. The motion of the first pivoting movement 21 is coupled via the lever element 12 to a second pivoting movement 23 of the flap 15.

The tab 11, the base part 10 and the lever element 12 interact in the manner of a toggle lever, such that a first pivoting movement 21 of the tab 11 about the first axis of rotation 16 by a first angular extent 22 causes a second pivoting movement 23 of the flap 15 relative to the opening plane 9, and a further first pivoting movement 21 of the tab 11 by a further first angular extent 22 causes a third pivoting movement 24 of the flap 15. Here, the second pivoting movement 23 and the third pivoting movement 24 are of different magnitude (see FIGS. 7 to 10 and 11 to 16).

The flap 15 is connected to the frame part 13 via a fourth axis of rotation 33. The fourth axis of rotation 33 is arranged positionally fixedly between the frame part 13 and flap 15. The flap 15 may also be connected to the frame part 13 via a hinge 25, wherein then, the flap 15 could perform not only the rotational movement relative to the frame part 13 but also a translational movement (not illustrated here).

Proceeding from the initial position 20, a first pivoting movement 21 of the tab 11 initially causes only a small second pivoting movement 23 of the flap 15, or said second pivoting movement 23 only occurs in the first place beyond a minimum extent of the first pivoting movement 21. If the tab 11 is pivoted progressively further, that is to say to the end position 32 of the tab 11, the flap 15 is pivoted with increasing intensity.

In the case of an unchanging rotational speed of the tab 11 about the first axis of rotation 16, it is thus the case that a rotational speed of the flap 15 about the fourth axis of rotation 33 varies. A rotational speed of the flap 15 is very low initially, that is to say proceeding from the initial position 20, whereas the rotational speed of the flap 15 increases as a first pivoting movement 21 of the tab 11 progresses.

The acting forces or torques vary inversely with respect to the rotational speeds or the speeds of the respective pivoting movement. Thus, in the case of the very low rotational speed of the flap 15, a very high torque can be transmitted to the flap 15, such that, specifically in the region of the initial position 20, that is to say when the flap 15 bears against the frame part 13 for the purposes of closing the window 14, a high torque is present for sealing the connection between flap 15 and frame part 13 or for opening the flap 15, that is to say for performing the second pivoting movement 23.

The frame part 13 is arranged captively on the opening edge 8. The frame part 13 is arranged on the opening edge 8 via a form-fitting connection, and is detachable from the opening edge 8 only through destruction of the frame part 13. The frame part 13 is installed on the opening edge 8 by way of a plastic deformation of the frame part 13. The plastic deformation may for example be performed by way of a thermal treatment of the frame part 13, for example at least local heating.

Between the inner side 7 and a contact surface 26 of the frame part 13, there is arranged a first gasket 27 which encircles the opening 4. The contact surface 26 is oriented parallel to a partial surface of the inner side 7 of the lid element 3. The first gasket 27 is arranged in the region of said partial surface. The first gasket 27 is fastened to the frame part 13 and is arranged on said partial surface during the course of installation of the frame part 13 on the lid element 3. The first gasket 27 may be producible or produced together with the frame part 13, and optionally also with the flap 15, during the course of a two-component injection molding process. It is optionally also possible for the first gasket 27 to be producible separately and then arrangeable in the intended position between contact surface 26 and lid element 3.

Between the frame part 13 and the flap 15, there is arranged a second gasket 28 which encircles the window 14. Said second gasket 28 allows sealing of the window 14 or of the opening 4 by way of a sealed connection between flap 15 and frame part 13. The second gasket 28 is arranged on the frame part 13. The second gasket 28 may be producible or produced together with the frame part 13 during the course of a two-component injection molding process. It is optionally also possible for the second gasket 28 to be producible separately and then arrangeable in the intended position between flap 15 and frame part 13.

The tab 11 is connected, only in a non-pivoted initial position 20, via a seal element 29 to the base part 10. The connection via the seal element 29 is destroyed when a first pivoting movement 21 of the tab 11 is performed for the first time. The seal element 29 serves for indicating the state of the closure element 5 or of the beverage container 2. An undamaged seal element 29 signals that the closure element 5 has not yet been actuated, that is to say the beverage container 2 has not yet been opened. By contrast, a damaged seal element 29 signals that the closure element 5 has been actuated at least once, that is to say the beverage container 2 has been opened at least once.

Figure 5:
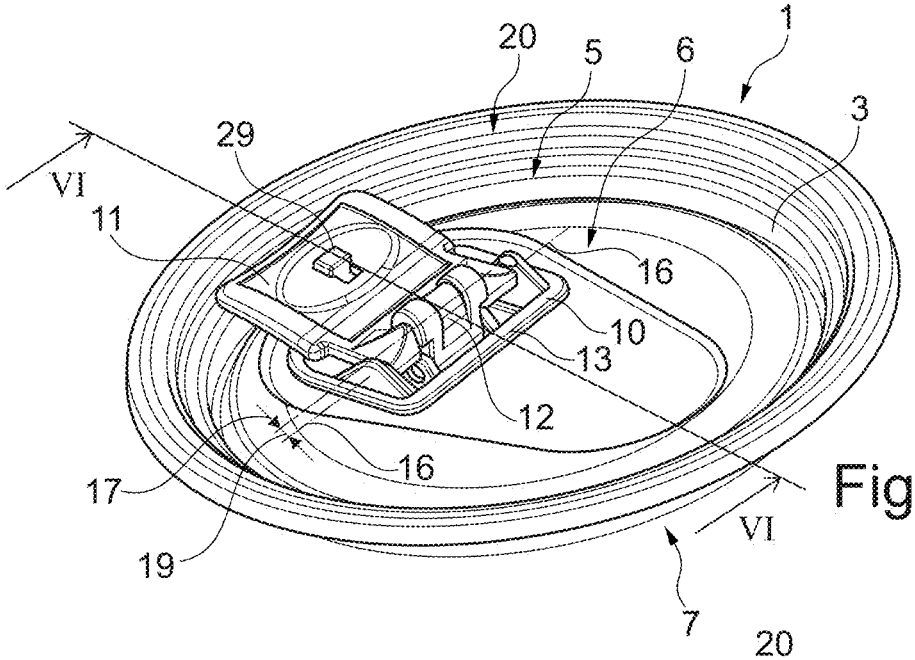
FIG. 5 shows the closure assembly as per FIG. 3 in a perspective view, with the tab in an initial position and section line VI-VI.
Figure 6:
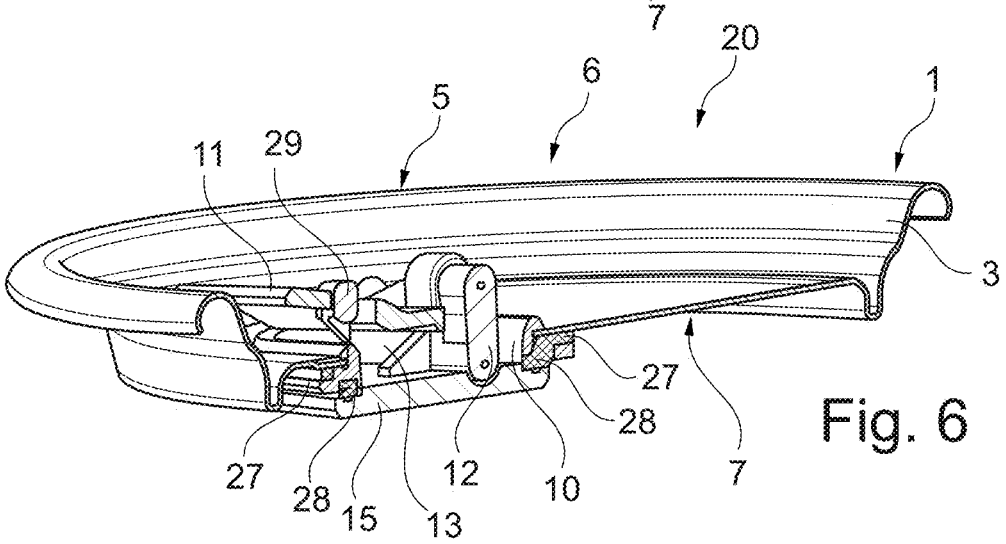
FIG. 6 shows the closure assembly as per FIG. 5 in a perspective view shown at a cross-section along section line VI-VI.
Figure 7:
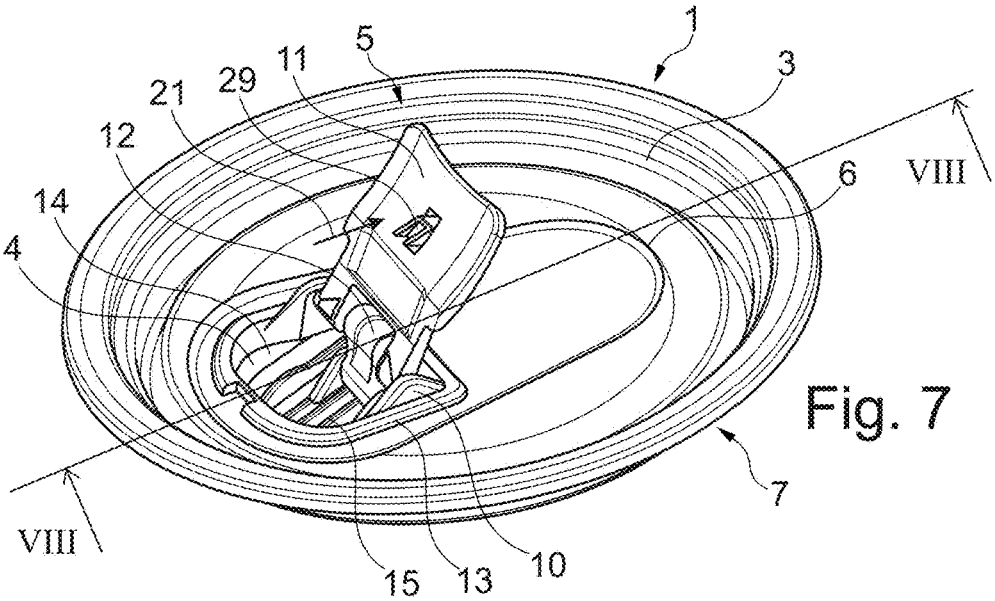
FIG. 7 shows the closure assembly as per FIG. 3 in a perspective view, with the tab in a pivoted position and section line VIII-VIII.
Figure 8:
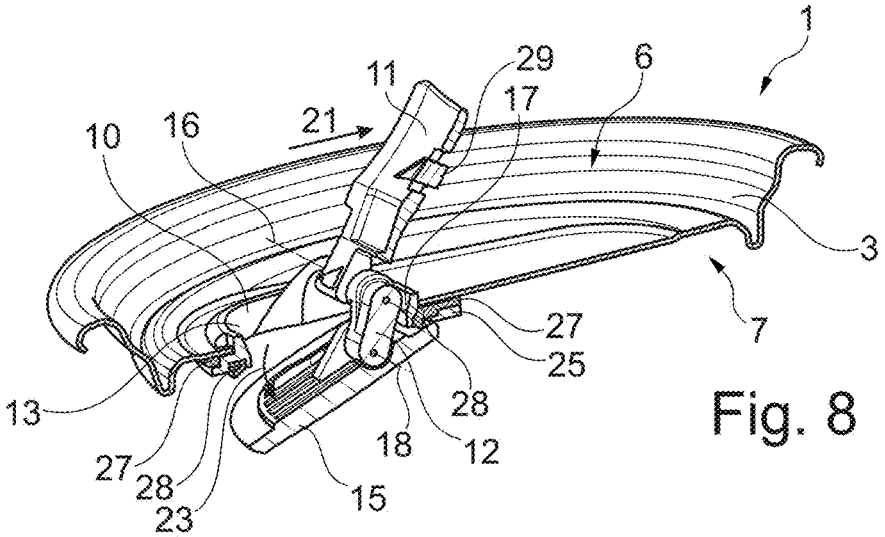
FIG. 8 shows the closure assembly as per FIG. 7 in a perspective view shown at a cross-section along section line VIII-VIII.
Figure 11:
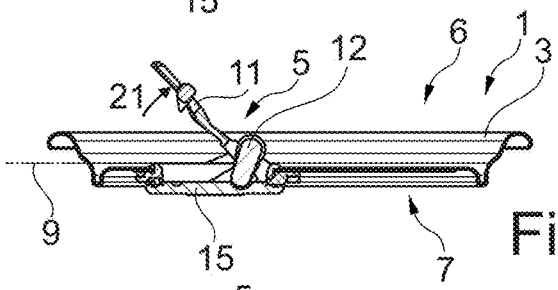
FIG. 11 shows the closure assembly as per FIG. 3 in a side view along section line VI-VI, with the flap closing the window.
Figure 12:
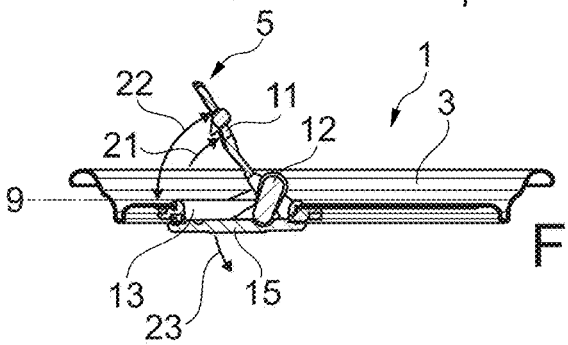
FIG. 12 shows the closure assembly as per FIG. 11 in a side view in section, with the flap having been pivoted by 1 angular degree.
Figure 13:
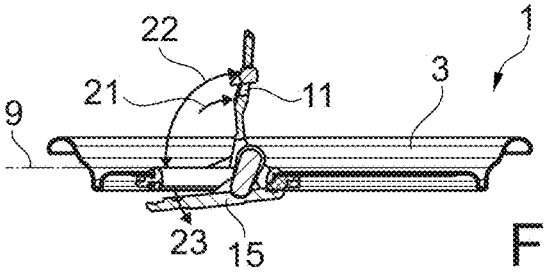
FIG. 13 shows the closure assembly as per FIGS. 11 and 12 in a side view in section, with the flap having been pivoted by 10 angular degrees.
Figure 14:
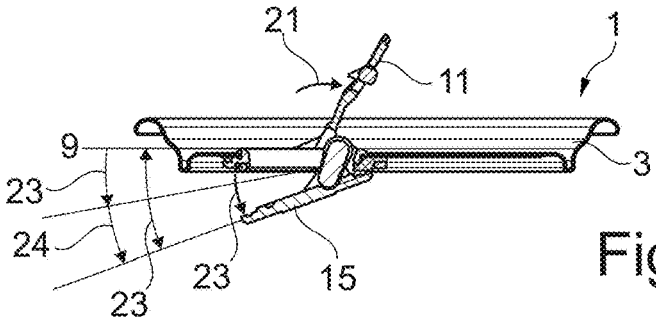
FIG. 14 shows the closure assembly as per FIGS. 11 to 13 in a side view along section view VIII-VIII, with the flap having been pivoted by 20 angular degrees.
Figure 15:
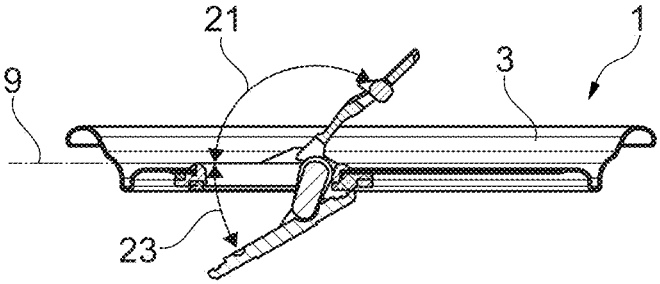
FIG. 15 shows the closure assembly as per FIGS. 11 to 14 in a side view in section, with the flap having been pivoted by 30 angular degrees.
Figure 16:
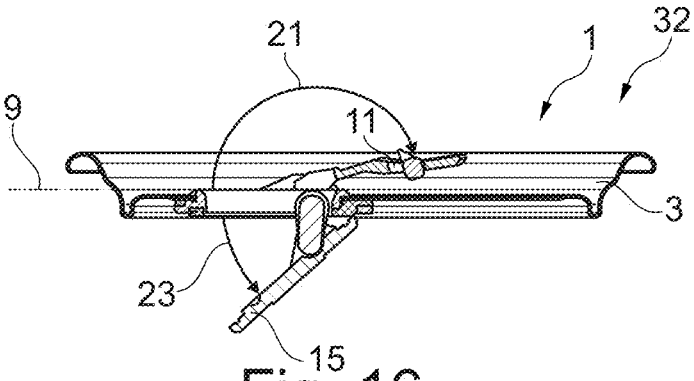
FIG. 16 shows the closure assembly as per FIGS. 11 to 15 in a side view along section view X-X, with the tab arranged in the end position.

FIG. 5 shows the closure assembly 1 as per FIG. 3 in a perspective view, with the tab 11 in an initial position 20. FIG. 6 shows the closure assembly 1 as per FIG. 5 in a perspective view in section VI-VI. FIG. 7 shows the closure assembly 1 as per FIG. 3 in a perspective view, with the tab 11 in a pivoted position. FIG. 8 shows the closure assembly 1 as per FIG. 7 in a perspective view in section VIII-VIII. FIG. 9 shows the closure assembly 1 as per FIG. 3 in a perspective view, with the tab 11 in an end position 32. FIG. shows the closure assembly 1 as per FIG. 9 in a perspective view in section X-X. FIG. 11 shows the closure assembly 1 as per FIG. 3 in a side view in section, with the flap 15 closing the window 14. FIG. 12 shows the closure assembly 1 as per FIG. 11 in a side view in section, with the flap having been pivoted by one angular degree. FIG. 13 shows the closure assembly 1 as per FIGS. 11 and 12 in a side view in section, with the flap having been pivoted by "10" angular degrees. FIG. 14 shows the closure assembly 1 as per FIGS. 11 to 13 in a side view in section, with the flap 15 having been pivoted by "20" angular degrees. FIG. 15 shows the closure assembly 1 as per FIGS. 11 to 14 in a side view in section, with the flap 15 having been pivoted by "30" angular degrees. FIG. 16 shows the closure assembly 1 as per FIGS. 11 to 15 in a side view in section, with the tab 11 arranged in the end position 32.

FIGS. 5 to 16 will be described jointly below. Reference is made to the statements relating to FIGS. 2 to 4.

Proceeding from a non-pivoted initial position 20 (see FIGS. 5 and 6), the first pivoting movement 21 of the tab 11 by at least approximately 55 angular degrees causes the second pivoting movement 23 of the flap 15 of approximately one angular degree (see FIG. 12). If the first pivoting movement 21 of the tab 11 is approximately 90 angular degrees, the flap 15 is pivoted further through the third pivoting movement 24, and the entire second pivoting movement 23 (that is to say the preceding second pivoting movement 23 and the third pivoting movement 24 together) is approximately 10 angular degrees (see FIG. 13). If the first pivoting movement 21 of the tab 11 is approximately 120 angular degrees, the second pivoting movement 23 is approximately 20 angular degrees (see FIG. 14). If the first pivoting movement 21 of the tab 11 is approximately 135 angular degrees, the second pivoting movement 23 is approximately 30 angular degrees (see FIG. 15). If the first pivoting movement 21 of the tab 11 is approximately 170 angular degrees, the second pivoting movement 23 is approximately 45 angular degrees (see FIG. 15).

Proceeding from the non-pivoted initial position 20, the first pivoting movement of the tab 11 by approximately 180 angular degrees, that is to say into the end position 32 causes the second pivoting movement 23 of approximately 45 angular degrees (see FIG. 16).

Proceeding from the initial position 20, a first pivoting movement 21 of the tab 11 initially causes only a small second pivoting movement 23 of the flap 15, or said second pivoting movement 23 only occurs in the first place beyond a minimum extent of the first pivoting movement 21 (FIGS. 11 and 12). If the tab 11 is pivoted progressively further, that is to say to the end position 32 of the tab 11, the flap 15 is pivoted with increasing intensity.

In the case of an unchanging rotational speed of the tab 11 about the first axis of rotation 16, it is thus the case that a rotational speed of the flap 15 about the fourth axis of rotation 33 varies. A rotational speed of the flap 15 is very low initially, that is to say proceeding from the initial position 20, whereas the rotational speed of the flap 15 increases as a first pivoting movement 21 of the tab 11 progresses.

The acting forces or torques vary inversely with respect to the rotational speeds or the speeds of the respective pivoting movement. Thus, in the case of the very low rotational speed of the flap 15, a very high torque can be transmitted to the flap 15, such that, specifically in the region of the initial position 20, that is to say when the flap 15 bears against the frame part 13 for the purposes of closing the window 14, a high torque is present for sealing the connection between flap 15 and frame part 13 or for opening the flap 15, that is to say for performing the second pivoting movement 23.

The tab 11 assumes a self-locking position in a maximally pivoted end position. Said self-locking position is stable, that is to say a torque is required to move the tab 11 out of said position. The tab 11 is, after the first actuation or pivoting of the tab 11, held in the initial position 20 by way of an elastic deformation of another component of the closure element 5. The elastic deformation of the other component allows the formation of a form fit or of a force fit, which prevents a further pivoting movement or a backward pivoting movement of the tab 11. This form fit or force fit can be eliminated again in particular by way of an actuation of the tab 11.

Figure 17:
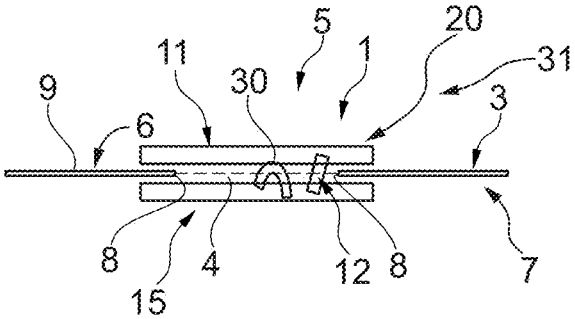
FIG. 17 shows a closure assembly in a side view in section, with the tab in an initial position.
Figure 18:
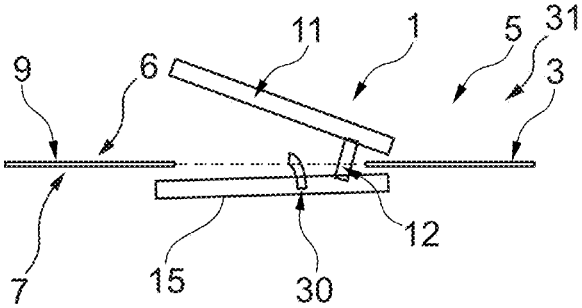
FIG. 18 shows the closure assembly as per FIG. 17 in a side view in section, with the tab in a pivoted position.

FIG. 17 shows a closure assembly 1 in a side view in section, with the tab 11 in an initial position 20. FIG. 18 shows the closure assembly 1 as per FIG. 17 in a side view in section, with the tab 11 in a pivoted position. FIGS. 17 and 18 will be described jointly below. Reference is made to the statements relating to FIGS. 2 to 16.

The base part 10 has a ventilation element 30, wherein, upon a first pivoting movement 21 of the tab 11, a fluidic connection is formed between the inner side 7 and the outer side 6 through the ventilation element 30. The first pivoting movement 21 of the tab 11 causes a deformation of the ventilation element 30. The ventilation element 30 is arranged on the flap 15. The ventilation element 30 is integrally connected to the base part 10. The ventilation element 30 may be producible or produced together with the frame part 13 and with the flap 15 during the course of a two-component injection molding process.

The ventilation element 30 is of tubular design and makes a fluidic connection possible between the interior or the inner side 7 of the beverage container 3 and the surroundings 31 of the beverage container 2. Venting, that is to say a pressure equalization between the interior of the beverage container 2 and the surroundings 31 of the beverage container 2, is possible via the ventilation element 30. The ventilation element 30 has, along the tubular form, a preferably constant minimum opening cross section of 1 to 4 $mm^2$. This minimum opening cross section is at least locally reduced to zero in the deformed state of the ventilation element 30, such that, when the tab 11 is arranged in the initial position 20, the fluidic connection is shut off, and therefore no ventilation is possible via the ventilation element 30 (see FIG. 17).

In the case of the closure element 5 proposed here, it is merely the case that the flap 15 is pivoted away from the frame part 13 in order to open up the window 14 or the opening 5. Here, before the pivoting of the flap 15, venting occurs via a ventilation element 30, such that the flap 15 does not need to be moved counter to the internal pressure that may prevail in the beverage container 2. Pivoting of the flap 15 may however also be possible with low torques even without a ventilation element 30 or venting, because a low torque at the tab 11 is converted into a high torque at the flap 15 owing to the toggle lever principle that is implemented.

Figure 19:
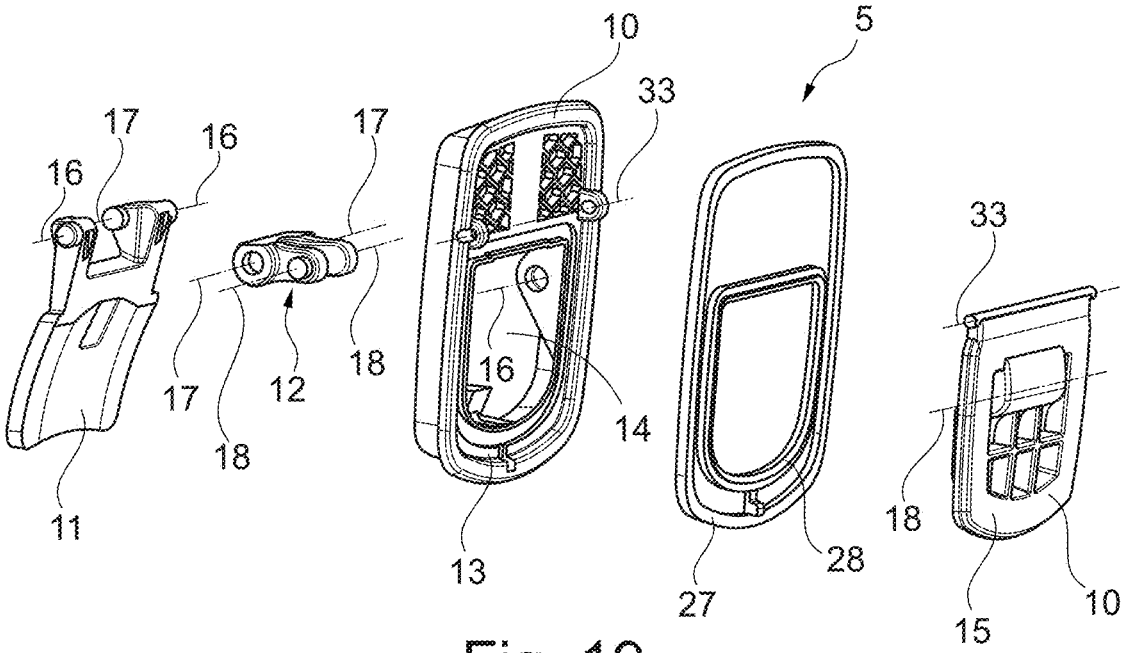
FIG. 19 shows a further closure element in an exploded illustration in a perspective view.
Figure 20:
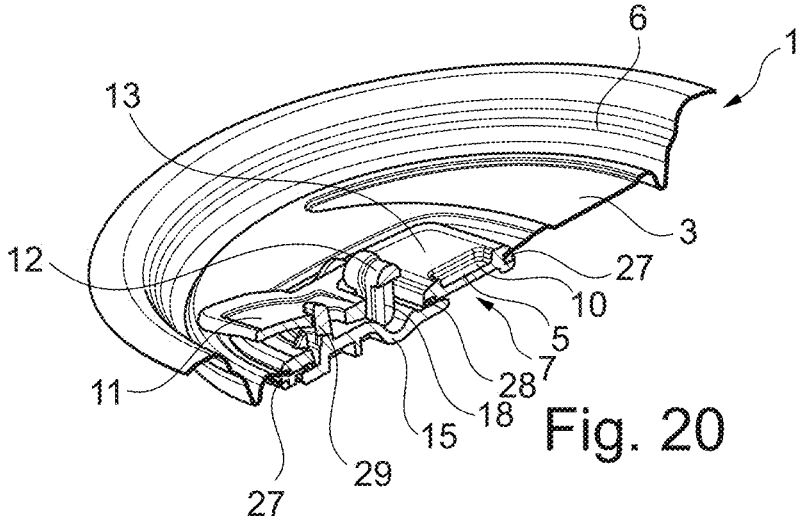
FIG. 20 shows a closure assembly with a closure element as per FIG. 19 in a perspective view in section.
Figure 21:
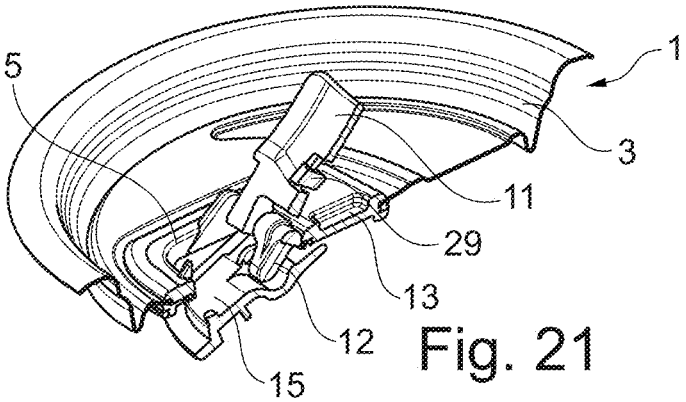
FIG. 21 shows the further closure assembly as per FIG. 20 in a perspective view in section.

FIG. 19 shows a further closure element 5 in an exploded illustration in a perspective view. FIG. 20 shows a closure assembly 1 with a closure element 5 as per FIG. 19 in a perspective view in section. FIG. 21 shows the further closure assembly 1 as per FIG. 20 in a perspective view in section. FIGS. 19 to 21 will be described jointly below. Reference is made to the statements relating to FIGS. 2 to 18.

In the case of the further closure element 5, by contrast to the closure element 5 that is illustrated in FIGS. 2 to 18, the flap 15 is pluggably connected to the frame part 13 via a fourth axis of rotation 33.

Furthermore, the lid element 3 is in this case illustrated in a different state of production, specifically only with an initially angled outer edge, and not with a bent-over outer edge (cf. FIGS. 3 to 16).

In particular, however, the arrangement of the closure element 5 is substantially independent of the state of production of the lid element 3. Optionally, only the opening 4 in the lid element 3 is required for the arrangement of the closure element 5, whilst other deformation processes could then also take place at a later point in time. It is however conventional for the lid element 3 to be fully deformed and for the closure element to only then be arranged on the lid element 3. The lid element 3 with closure element 5 is connected to the rest of the beverage container 2, that is to say base and wall, to form the finished beverage container 2.

Whereas the base part 10 in the case of the closure element as per FIGS. 2 to 18 is formed as a single piece (frame part 13 and flap 15 are cohesively connected at the fourth axis of rotation 33), the base part 10 in the case of the further closure element as per FIGS. 19 to 21 is of at least two-part form (frame part 13 and flap 15 form a pluggable connection, with the fourth axis of rotation 33 being formed by means of the connection).

Figure 22:
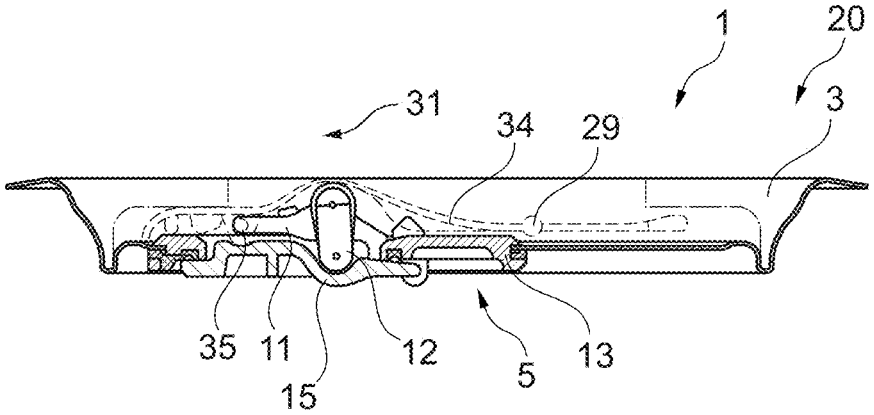
FIG. 22 shows a closure assembly with a protective flap in a side view in section.
Figure 23:
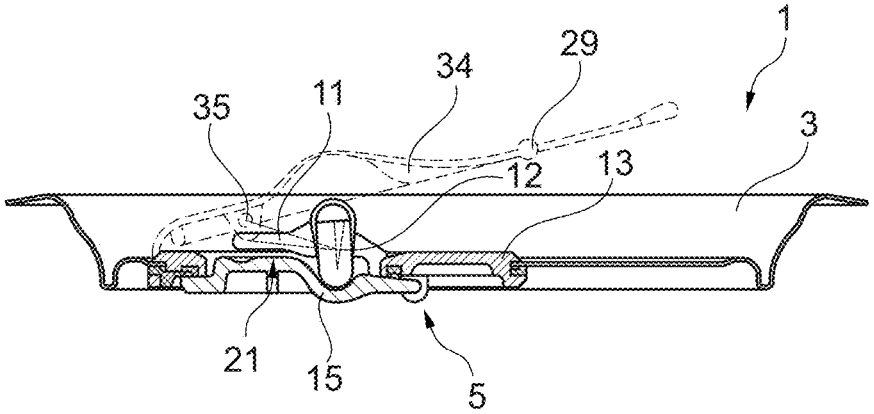
FIG. 23 shows the closure assembly as per FIG. 22, with the protective flap in a pivoted position.
Figure 24:
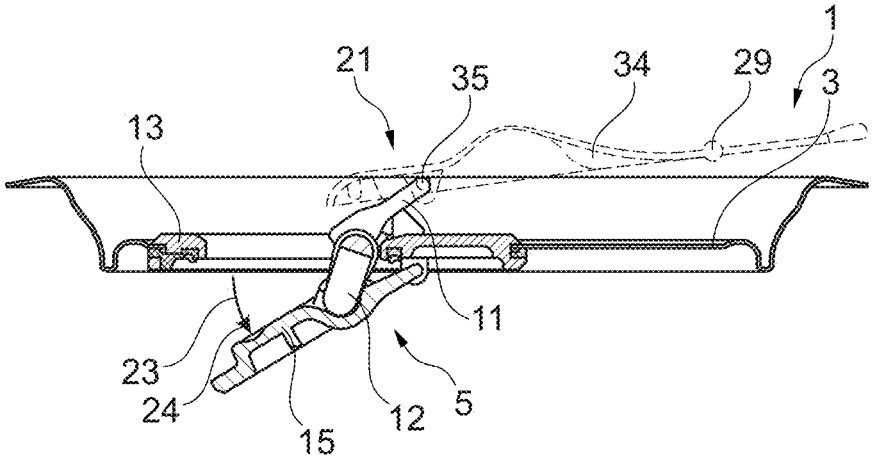
FIG. 24 shows the closure assembly as per FIGS. 22 and 23, with the tab in an end position.

FIG. 22 shows a closure assembly 1 with a protective flap 34 in a side view in section. FIG. 23 shows the closure assembly 1 as per FIG. 22, with the protective flap 34 in a pivoted position. FIG. 24 shows the closure assembly 1 as per FIGS. 22 and 23, with the tab 11 in an end position 32. FIGS. 22 to 24 will be described jointly below. Reference is made to the statements relating to FIGS. 19 to 21.

By contrast to the closure element 5 that is illustrated in FIGS. 19 to 21, the closure element 5 illustrated here has a protective flap 34 that is pivotably connected to the tab 11, which is now of shortened design, via a fifth axis of rotation 35. The protective flap 34 covers the opening 4 and/or the window 14 and thus enables at least parts of the closure element 5 to be arranged so as to be protected with respect to the surroundings 31. The protective flap 34 has a seal element 29 via which the protective flap 34 is connected to the frame part 13. A movement of the protective flap 34 for the first time causes the seal element 29 to be destroyed.

It can be seen in FIG. 23 that the protective flap 34 is (proceeding from an initial position 20) moved initially in a first direction of rotation, and the seal element 29 is thus destroyed. It can be seen in FIGS. 23 and 24 that a further pivoting movement of the protective flap 34 then causes the tab 11 to be pivoted (first pivoting movement 21 in FIG. 23), wherein the protective flap 34 is at least temporarily supported on the lid element 3.

In FIG. 24, the protective flap 34 and the tab 11 are arranged in a fully pivoted end position 32, with the flap 15 likewise in an arrangement in which it has been pivoted through the second pivoting movement 23 and through the third pivoting movement 24.

LIST OF REFERENCE DESIGNATIONS

1 Closure assembly
2 Beverage container
3 Lid element
4 Opening
5 Closure element
6 Outer side
7 Inner side
8 Opening edge
9 Opening plane
10 Base part
11 Tab
12 Lever element
13 Frame part
14 Window
15 Flap
16 First axis of rotation
17 Second axis of rotation
18 Third axis of rotation
19 Spacing
20 Initial position
21 First pivoting movement
22 First angular extent
23 Second pivoting movement
24 Third pivoting movement
25 Hinge
26 Contact surface
27 First gasket
28 Second gasket
29 Seal element
30 Ventilation element
31 Surroundings
32 End position
33 Fourth axis of rotation
34 Protective flap
35 Fifth axis of rotation

The invention claimed is:

1. A closure assembly for a beverage container comprising:

a lid comprising an outer side and an inner side, the lid comprising an opening; and a closure which is arranged on the lid configured for repeatably closing the opening, the closure comprising a base, a tab and a lever, wherein the opening in the lid comprises an opening edge, wherein the base comprises a frame and a window, the frame positioned along the opening edge, the window passing through the frame;

wherein the base comprises a flap pivotably connected to the frame, the flap configured to close the window, wherein the tab pivots around a first axis of rotation relative to the frame, wherein the lever is configured to pivot around a second axis of rotation on the tab and around a third axis of rotation on the flap, and wherein the lever connects to other components of the closure assembly only at the tab and the flap.

2. The closure assembly of claim 1, wherein the first axis of rotation and the second axis of rotation are arranged parallel and with a spacing to one another.

3. The closure assembly of claim 1, wherein the tab is pivotable from a non-pivoted initial position in a first pivoting movement about the first axis of rotation to pivot the flap relative to the frame.

4. The closure assembly of claim 3, wherein a force required for the first pivoting movement of the tab is at most 20 newtons.

5. The closure assembly of claim 1, wherein the tab, the base and the lever are configured such that a first pivoting movement of the tab about the first axis of rotation by a first angular extent causes a second pivoting movement of the flap relative to the opening edge, and further pivoting of the tab by a further extent in the same direction as the first angular extent causes a third pivoting movement of the flap, and wherein the second pivoting movement and the third pivoting movement are of a different magnitude.

6. The closure assembly of claim 5, wherein rotation of the first pivoting movement of the tab by at least 45 angular degrees causes the second pivoting movement of at most 5 angular degrees.

7. The closure assembly of claim 6, wherein rotation of the first pivoting movement of the tab by at most 150 angular degrees causes the second pivoting movement of at least 30 angular degrees.

8. The closure assembly of claim 1, wherein the flap is connected to the frame via a hinge or via a fourth axis of rotation.

9. The closure assembly of claim 1, wherein the frame is arranged within the opening edge of the lid.

10. The closure assembly of claim 1, wherein the closure is configured to form a repeatable gas-tight closure of the opening.

11. The closure assembly of claim 1, further comprising a first gasket arranged between the inner side and a contact surface of the frame, wherein the first gasket encircles the opening.

12. The closure assembly of claim 11, further comprising a second gasket arranged between the frame and the flap, wherein the second gasket encircles the window.

13. The closure assembly of claim 1, wherein:

when the tab is in a non-pivoted initial position, the tab is connected via a seal element to the base;

a first pivoting the tab from the non-pivoted initial position damages the seal element to remove the connection of the seal element between the tab and the base; and damage to the seal element indicates that the tab has been actuated at least once.

14. The closure assembly of claim 1 further comprising a ventilation element arranged in the base;

wherein, upon a first pivoting movement of the tab, a fluidic connection is formed between the inner side and the outer side through the ventilation element, and wherein, when the tab is in a non-pivoted initial position, the ventilation element is deformed to shut off the fluidic connection.

15. The closure assembly of claim 1, wherein:

when the tab is in a non-pivoted initial position, the flap forms a fluid-tight connection with the frame, when the tab is rotated during a first pivoting movement, a second pivoting movement of the flap eliminates the fluid-tight connection, and the closure assembly is configured such that removal of a fluid stored by the beverage container occurs exclusively as a result of the elimination of the fluid-tight connection.

16. The closure assembly of claim 1, wherein:

when the tab is in a non-pivoted initial position, the tab self-locks where torque is required to move the tab; and when the tab is in a maximally pivoted end position, the tab self-locks where torque is required to move the tab.

17. The closure assembly of claim 1 further comprising a protective flap configured to protect the tab when the tab is in a non-pivoted initial position.

18. The closure assembly of claim 17, wherein the protective flap is pivotably connected via a fifth axis of rotation to the tab.

19. A method for repeatably closing an opening of the beverage container of claim 1, the method comprising:

pivoting the tab about the first axis of rotation by a first angular extent in a first pivoting movement, wherein the flap is thus pivoted relative to the opening edge through a second pivoting movement; and performing a further pivoting of the tab by a further extent in the same direction as the first angular extent, wherein the flap is thus pivoted relative to the opening edge through a third pivoting movement, wherein the second pivoting movement and the third pivoting movement are of a different magnitude.

20. The method of claim 19, wherein the base includes a ventilation passage, wherein, upon the first pivoting movement of the tab out of a non-pivoted initial position in which the window is closed by the flap, a fluidic connection is formed between the inner side and the outer side through the ventilation passage, and pressure equalization between the beverage container and surroundings is thus realized, and wherein the first pivoting movement of the tab causes a deformation of the ventilation passage.

21. The method of claim 19, wherein, in a non-pivoted initial position of the tab in which the window is closed by the flap, the flap forms a fluid-tight connection with the frame, wherein, upon the first pivoting movement of the tab, the fluid-tight connection is eliminated as a result of the second pivoting movement of the flap, and wherein pressure equalization between a content of the beverage container and surroundings is performed exclusively as a result of the elimination of the fluid-tight connection.

* * * * *